United States Patent [19]

Phillips

[11] 4,004,179

[45] Jan. 18, 1977

[54] SLOW WAVE CIRCUIT HAVING SERIALLY CONNECTED CONTRAWOUND TWO-TURN HELICES

[75] Inventor: Robert Matthews Phillips, Redwood City, Calif.

[73] Assignee: Litton Systems, Inc., San Carlos, Calif.

[22] Filed: Oct. 20, 1975

[21] Appl. No.: 623,718

[52] U.S. Cl. ..... 315/3.5; 315/3.6; 315/39.3; 333/31 R

[51] Int. Cl.[2] ..... H01J 25/34

[58] Field of Search ..... 315/3.6, 3.5, 39.3; 333/31, 31 R

[56] References Cited

UNITED STATES PATENTS

| | | | |
|---|---|---|---|
| 2,813,221 | 11/1957 | Peter | 315/3.5 |
| 2,882,440 | 4/1959 | Mourier | 315/3.5 |
| 2,955,223 | 10/1960 | Kompfner et al. | 315/3.5 |
| 2,957,103 | 10/1960 | Birdsall | 315/3.6 |
| 3,273,081 | 9/1966 | Itzkan | 315/3.6 X |
| 3,358,179 | 12/1967 | Farney | 315/3.5 |
| 3,396,348 | 8/1968 | Wang | 315/3.5 X |
| 3,413,512 | 11/1968 | Buck | 315/3.6 X |
| 3,646,389 | 2/1972 | Hentschel | 315/3.5 |
| 3,760,223 | 9/1973 | Jasper, Jr. | 315/3.6 |

*Primary Examiner*—Saxfield Chatmon, Jr.
*Attorney, Agent, or Firm*—Ronald M. Goldman

[57] ABSTRACT

As part of a microwave frequency device, such as a traveling wave tube, a novel slow wave structure is presented which comprises an electrically conductive wire formed into a series of interconnected loops which are spaced apart and parallel along a common axis, with said loops being arranged in alternate and intermediate pairs, the ones of said loops in said alternate pairs extending clockwise about said common axis and with the ones of said loops in said intermediate pairs extending counterclockwise about said axis and interconnecting portions of said wires joining ends of adjacent loops together to define a series electrical path which progresses from one end of the wire to the other seriatim through all said loops.

20 Claims, 7 Drawing Figures

SLOW WAVE CIRCUIT HAVING SERIALLY CONNECTED CONTRAWOUND TWO-TURN HELICES

BACKGROUND OF THE INVENTION

My invention relates to slow wave circuits and, more particularly, to slow wave circuits useful as component elements of traveling wave tubes and other microwave frequency apparatus.

Certain high frequency microwave devices useful in the microwave frequency spectrum employ as an element a circuit device variously known in the art as a traveling wave circuit or slow wave structure. Common and well known devices of that type include the O-type traveling wave tube and phase shifters. As is known to those skilled in the art, there exists a large number of slow wave circuits or structures or various types and geometries having various electrical characteristics that differ from one another in known ways. Two slow wave structures that are widely known and used are the ring loop and the helix. One purpose of the slow wave structure is to reduce the propagation velocity of a signal of the microwave frequency spectrum to a lower velocity from the normal propagation velocity theoretically approximating the speed of light. By way of example, the microwave signal applied to one end of an elongated spiral helix propagates around the turns of the helix at the speed of light but in effect propagates along the axis of the helix at an effectively lower velocity than the speed of light, the exact velocity being dependent upon the number of turns per unit of axial length of the axis in the helix and the helix diameter. Other examples of slow wave structures are illustrated in patents U.S. Pat. No. 3,287,668 to Veith et al, U.S. Pat. No. 3,273,081 to Itzkan, U.S. Pat. No. 2,957,103 to Birdsall, U.S. Pat. No. 3,230,485 to Sobotka, U.S. Pat. No. 3,508,108 to Salisbury, U.S. Pat. No. 3,413,512 to Buck, U.S. Pat. No. 3,050,657 to Branch, U.S. Pat. No. 1,945,544 to Conklin, U.S. Pat. No. 3,639,860 to Breitenbach, which have been made known to me, and in *Traveling Wave Tubes Theory and Application*, published 1971, Litton Precision Products, Inc. And a ring loop circuit is presented in my prior patent U.S. Pat. No. 3,716,745. Many of the aforecited references illustrate the slow wave structure as an element of the conventional O-type traveling wave tube.

The traveling wave tube is a microwave frequency device used primarily as an amplifier of microwave frequency signals. The tube operates on the physical phenomenon of an electronic interaction that occurs between electrons moving by a slow wave circuit and a microwave signal propagating along the slow wave circuit. By means of this interaction, kinetic energy in the electrons is converted into power in the microwave frequency signal. In its essentials the traveling wave tube includes a source of electrons, a slow wave structure enclosing an interaction region, a collector located at the end of the interaction region, an input coupling to one end of the slow wave structure for coupling of microwave frequency source to the slow wave structure and an output coupling located at the other end of the slow wave structure for coupling out amplified microwave frequency signals. The aforecited elements are contained in an envelope maintained in high vacuum. The exact details of construction, additional elements and operation of such prior art devices in which the present invention is to be incorporated as an element is described in the prior art literature, including the cited patents, known to those skilled in the art, to which the reader may make reference. Several electrical characteristics of interest in a slow wave structure include frequency bandwidth, efficiency, gain per unit wavelength, harmonic power generation, dispersiveness, interaction velocity, interaction impedance, and $\omega$-$\beta$ characteristic.

The present invention relates to a slow wave structure as an element of a microwave frequency apparatus, such as a traveling wave tube, and to a novel configuration of a conductor formed in a microwave apparatus combination as a path for electromagnetic energy in the microwave frequency range possessing certain desirable electrical characteristics and obtaining certain desired results.

OBJECTS OF THE INVENTION

Accordingly, one object of my invention is to provide a novel slow wave structure.

Another object of may invention is to provide a microwave frequency apparatus having a novel electrically conductive path configuration and functioning as a traveling wave circuit or slow wave structure.

And an additional object of my invention is to provide a novel configuration in a slow wave structure having certain desirable electrical characteristics of the prior art ring-loop type slow wave structure and certain other desirable electrical characteristics of a prior art helix type slow wave structure.

SUMMARY OF THE INVENTION

In accordance with those objects the invention comprises an improvement in a microwave frequency device, such as a traveling wave tube, of the type containing a slow wave structure in which the slow wave structure has a geometric configuration in which a conductive wire is formed into a series of loops that are spaced apart and parallel along a common axis with said loops being arranged in alternate and intermediate pairs of loops, the ones of said loops in the alternate pairs extending clockwise about the common axis and the one of said loops of said intermediate pairs of loops extending counterclockwise about said common axis, and with interconnecting wire portions between each loop joining one end of adjacent loops together to form a series electrical path which progresses from one end of the wire seriatim through all said loops to the other end.

The foregoing objects and advantages of my invention together with the structure characteristic of my invention summarized briefly above, as well as modifications and equivalents thereto, is better understood by giving consideration to the detailed description of a preferred embodiment of my invention, which follows, taken together with the figures of the drawings.

DESCRIPTION OF THE PREFERRED EMBODIMENTS

Figure 1:
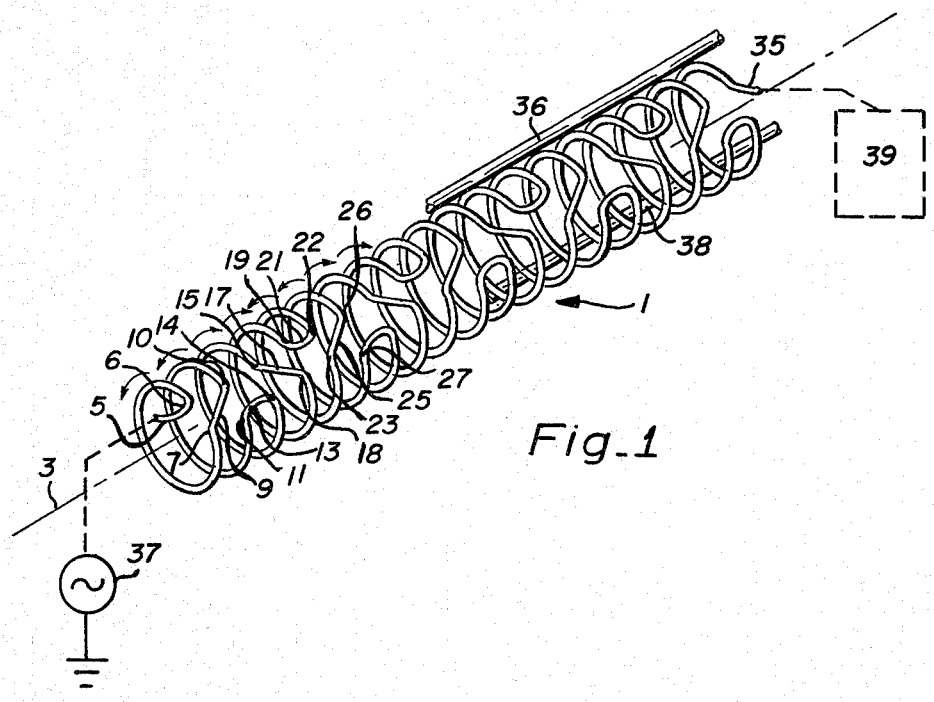
FIG. 1 illustrates in isometric perspective a preferred embodiment of my invention.

The configuration of a preferred embodiment of the invention illustrated in FIG. 1 as presented in a not-to-scale isometric perspective shows a slow wave structure consisting of a single strand of electrically conductive wire 1 shaped into a series of interconnected turns or loops about an imaginary axis 3. The slow wave structure begins at an end 5, is formed into a first loop which extends from a loop location or end 6 counterclockwise about axis 3, as indicated by the arrow, forming an incomplete circle at approximately loop location end 7. A connecting portion of the wire 9 extends from loop end 7 axially and upwardly to a location 10 to a second formed loop. The second loop also extends counterclockwise about axis 3, as indicated by the arrow, forming an incomplete circle ending essentially at a point or loop end 11. Another connecting portion 13 extends from end 11 of the second loop axially and parallel to the axis to an end 14 of an adjacent third loop. The third loop extends clockwise about axis 3, as indicated by the arrow, and ends at a position end 15 and in turn the third loop is connected by connecting portion 17, which extends axially and downwardly to end 19 of the next adjacent fourth loop. This fourth loop also extends clockwise about axis 3, as indicated by the arrow, and at end 20 is connected by a portion 21, which extends axially and parallel to axis 3, to end 22 of the next adjacent or fifth loop. The fifth loop extends counterclockwise about axis 3, as indicated by the arrow, to an end 23 and that end is connected by an upwardly and axially extending connecting portion 25 to the next adjacent loop or sixth loop at 26. The sixth loop extends counterclockwise about the axis 3, as indicated by the arrow, to its end 27. The formed configuration continues in such fashion with the next two loops extending about the axis clockwise and the next succeeding two loops extending about the axis counterclockwise, and so on, for each pair of loops for all of the nineteen loops until the end of the wire 35 is reached. For convenience, the pairs of loops can be considered as alternate pairs and intermediate pairs of loops. Inasmuch as an odd number of loops is illustrated, one pair will not be complete. However the one extra turn does not detract from the operation or description of the invention. As is illustrated, an electrically conductive microwave signal propagating path is formed which progresses from end 5 through each loop and connecting portion in sequence or seriatim all the way to end 35. For purposes of illustration, in combination a microwave energy source 37 is symbolically illustrated as connected to one end of the slow wave structure and a microwave energy load 39 is symbolically illustrated and is coupled to end 35 of the slow wave structure. Moreover, partial sections of two ceramic insulator support rods 36 and 38 which conventionally support a slow wave structure in a traveling wave tube are shown abutting the slow wave circuit. Three support rods are normally used in practice, but a third rod is omitted so as to not detract from the illustration.

Figure 2:
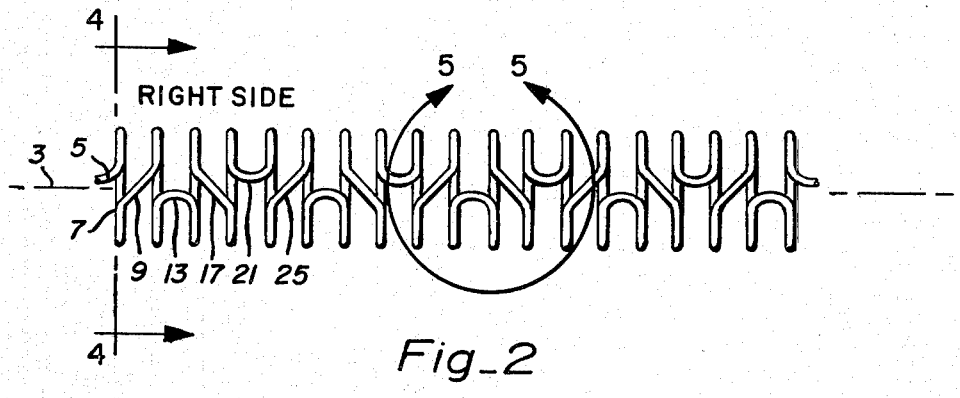
FIG. 2 illustrates in perspective a right side view of the embodiment of FIG. 1 in reduced scale.
Figure 3:
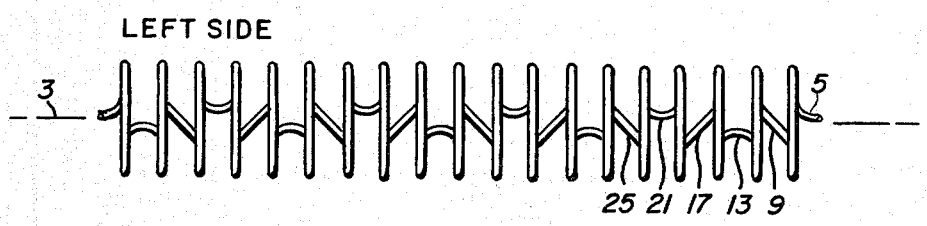
FIG. 3 illustrates the mirror image of the perspective view of FIG. 2.

In order to visualize the embodiment more completely as well as define the slow wave structure, reference is made to the perspective side views of FIG. 2 and FIG. 3. For clarity of understanding the elements which appear in this figure are identified by the same numbers used in connection with the illustration of those elements in FIG. 1 and the illustration is to be a reduced scale. As is apparent from this figure, the loops forming the slow wave structure are spaced from one another along axis 3, are essentially parallel to one another and, as is more apparent from FIG. 4, the loops are in alignment. As viewed from the side the connecting portions of the wire which connect an end of one loop to one end of an adjacent loop in the defined configuration, such as the connecting portions 9, 13, 17, 21, form a unique geometrical pattern which is repeated with the additional loops. It is noted that although the embodiment has the loops spaced apart evenly along axis 3, it is within known practice and within the scope of this invention to vary this spacing and to have some turns of the structure separated by lesser distances than other turns as is done to increase interaction efficiency with helix type slow wave circuits. Considering a plane orthogonal to the surface of the drawing through axis 3, it is apparent that connecting portion 13 is essentially parallel to axis 3 and lies under the plane, whereas connecting portion 21 is essentially parallel to the axis 3 and lies over the aforedescribed plane. On the other hand, connecting portion 9 is skew to axis 3 and extends from the end of the first loop underlying the plane, intersects the plane, and connects to the end of the second loop located above the said plane. Similarly connecting portion 17 extends from the upper end of the third loop at a location above the orthogonal plane to the end of the fourth loop underlying the plane extending skew to axis 3 and intersecting the orthogonal plane.

Figure 4:
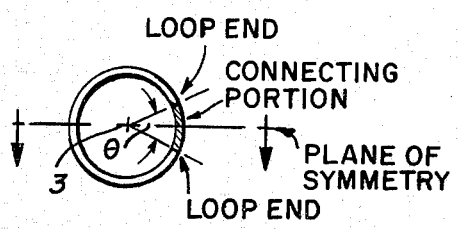
FIG. 4 is an axial section taken along 1—1 in FIG. 2.
Figure 5:
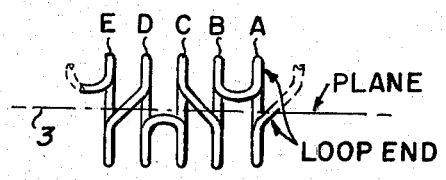
FIG. 5 is a segment A taken from FIG. 2.

Understandably, those skilled in the art can visualize and reproduce the slow wave circuit based on the foregoing illustrations. However, in order to ensure that specific aspects of the foregoing embodiment are adequately defined, additional FIGS. 4 and 5 are separately considered. In FIG. 4 I illustrate the embodiment of FIG. 2 taken along the Section 1—1. As is apparent from this view, each loop in the slow wave structure lies in a plane and forms a partially complete circle between what I have heretofore characterized as the loop ends. The periphery of the loop extends over an angle of $2\pi$-$\theta$ radians, where $\theta$ is the angle of the sector illustrated defining the omitted portion of the circle. Also visible in this view is the connecting portion which extends from the loop end axially to the upper loop end of the adjacent loop. As is apparent, each of the loops in the slow wave structure is angularly and axially aligned about axis 3. As was described in connection with FIG. 2, a plane through axis 3 orthogonal to the plane of the paper, which I characterize as a plane of symmetry, divides the loop into two symmetrical portions, each of which extends about an angle of $\pi$-$\theta/2$ radians.

The plane of symmetry orthogonal to the plane of drawing through axis 3 is considered in FIG. 5, which figure is the Section A taken from FIG. 2. There is again illustrated a sequence of five loops, A, B, C, D and E. One end of loop A is connected to the adjacent loop B by a connecting portion located above the plane of symmetry and substantially parallel to axis 3. The next connecting portion is connected to the end of the second loop underlying the plane and extends skew to axis 3 through the plane of symmetry to the upper end of the adjacent loop C. Another connecting portion extends axially essentially parallel to the axis 3 and underlying the plane from the end of loop C to the one end of loop D underlying the plane. The next connecting portion extends from the end of loop D located above the plane skew to axis 3 and through the plane to one end of loop E underlying the plane. It is believed that the foregoing description of the connections of these loops is adequate to define the invention. Taking any one loop it is seen that the connecting portion to one side connecting to an adjacent loop is skew to axis 3 and the connecting portion which connects that given loop with the adjacent loop on the other side is substantially parallel to axis 3.

Figure 6:
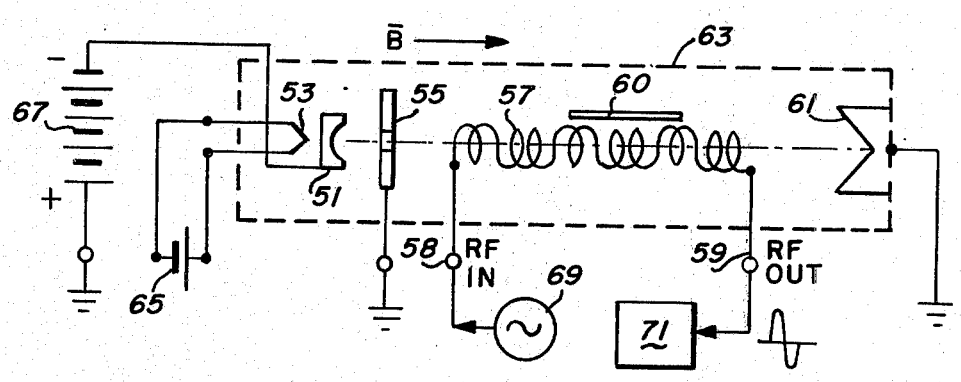
FIG. 6 schematically illustrates a traveling wave tube in which the slow wave structure is employed.

In FIG. 6 I present a traveling wave tube known in the prior art but modified to incorporate the novel slow wave structure of the invention. Inasmuch as the traveling wave tube per se is a very well known device, it may be illustrated and described schematically. The traveling wave tube contains a cathode 51, a cathode heater 53, an anode 55 having a passage 56, slow wave structure 57 having a signal input coupling 58 and a signal output coupling 59 and attenuator 60 and a collector 61 which are located in a vacuum envelope 63, represented in dash lines. Cathode 51 and cathode heater 53 are located at one end of the tube. Anode 55 is spaced from and located in front of the cathode and the slow wave structure is mounted behind and spaced from anode 55. Suitably the symbol chosen for the slow wave circuit is a plurality of pairs of two turn helix loops, one pair clockwise, the other pair counterclockwise and interconnected. The slow wave circuit is supported by dielectric rods, not illustrated, in housing 63. Collector 61 is located at the rear end of slow wave structure 57. Suitably connections 58 and 59 are connected or coupled respectively to the input end and output end of slow wave structure 57. A focusing magnetic field to assist in maintaining the trajectory of the electron beam, supplied by a system of ring-shaped permanent magnets, focusing solenoids, or device of like nature normally attached to the tube structure, is represented by the arrow and symbol B. A power supply for the TWT includes at least a source of heater voltage, represented by battery 65, and a source of high voltage DC represented by battery 67. The high voltage source has its negative polarity terminal connected to cathode 51 and its positive terminal connected to ground potential. Each of the collector 61 and anode 55 are connected to ground. A source of microwave signal 69 is coupled to the input 58 and an electrical load 71 or other device using microwave signals is connected to the output 59. Current from source 65 is supplied to heater 53 which in turn heats cathode 51. High voltage source 67 places anode 55 and collector 61 at a high positive voltage with respect to cathode 51. Electrons travel from cathode 51, are accelerated and pass through anode 55 and pass along the axis of slow wave structure 55 defining the interaction region, to the collector 61 through which they are returned to source 67. The configuration illustrated is that of a microwave amplifier in which the microwave signals applied from the source 69 to input 58 is amplified along slow wave structure 57 and appears as amplified microwave signals at output 59. For a more detailed analysis and description of the structure and operation of conventional traveling wave tubes the reader is referred to the prior art literature, including the publication *Traveling Wave Tubes, Theory and Application*, published 1971 by Litton Precision Products, Inc., and my prior patent U.S. Pat. No. 3,716,745.

Although the preferred embodiment as described employs loops which lie in a plane to form a partially complete circle, another variation is to employ a helix, in which no portion of a turn lies in a single plane. Thus viewing the structure presented in the preferred embodiment of the preceding figures and as specifically illustrated in FIG. 6 one can visualize each pair of contraclockwise wound loops as being replaced by two turn helices extending contraclockwise about the axis and each pair of clockwise formed loops being replaced by two turn helices extending clockwise about the axis. In so varying the slow wave structure of the invention in detail from that of the preferred embodiment, it is apparent that only slight change occurs in the overall electrical characteristics and in the results from that obtained with the preferred embodiment.

The slow wave structure is formed into the shape illustrated preferably by winding the wire on a mandrel of a metal dissimilar to the metal of the wire and then chemically dissolving the mandrel to leave the formed meandix line. The meandix line is then supported by dielectric rods and processed into the traveling wave tube housing using the same conventional techniques for prior art slow wave structure and traveling wave tube processing and assembly.

One specific example of the preferred embodiment of FIG. 1 was constructed using molybdenum wire 0.02 inches in diameter with loops spaced approximately 0.03 inches apart, an inner loop diameter of 0.23 inches and an outer loop diameter of 0.27 inches and having approximately 60 loops evenly spaced. The structure was supported in a traveling wave tube by three 0.10 diameter berylia rods and the tube was operated in the frequency range of 1.3 to 1.8 gigahertz at an anode voltage of 3 to 4 kilovolts to obtain power outputs of 200 to 500 watts at efficiencies of between 25 to 30 percent. The bandwidth about a particular frequency of operation within that range was approximately 12 percent of the frequency.

Generalizing somewhat, the structure is useful having a pitch and diameter falling within a range of the following ratio: $0.1<g/a<0.5$, where $d$ is the inner diameter of the loop and $g$ is the axial loop to loop spacing measured from the center of the loop conductor.

In order to more completely present the advantages of my invention, a comparison with prior art slow wave structures that I consider pertinent may be made.

As is known to those skilled in the art, traveling wave tubes having slow wave circuits function as amplifiers of microwave signals. The signal is applied to an input at one end of the slow wave circuit and a larger amplitude signal is taken from the output end of the slow wave circuit. And amplification is accomplished as a result of the phenomenon of electronic interaction between moving electrons which possess kinetic energy and a propagating microwave frequency signal that has fields in the path of the electrons. By means of this phenomenon the moving electron is slowed in velocity and gives up some of its kinetic energy to the microwave signal thereby increasing the energy in the microwave signal. In order to accomplish this the velocity of the moving electrons entering the interaction region must be approximately matched to the velocity of the propagating microwave signal, i.e. the electrons must move at a slightly higher velocity than the propagation velocity of the microwave signal on the slow wave circuit.

Given certain variables and physical limitations the velocity of the microwave signal is established by the slow wave circuit and the velocity of the electrons is established by an accelerating voltage. The velocity of the microwave signal is established by the slow wave circuit. If the slow wave circuit is a helix, the axial propagation velocity of the signal depends upon the number of turns or loops per unit length in the helix, referred to as the "pitch", i.e. with a fewer number of turns per unit length of helix, lesser pitch, a microwave signal applied to the helix travels axially at a greater velocity and with a large number of turns per unit length, greater pitch, the microwave signal applied to the helix travels axially at a lesser axial velocity. Various considerations known to those skilled in the art limit the maximum and minimum number of turns in a helix.

In the ring-loop type of slow wave circuit, consisting of a series of spaced ring-shaped elements joined together by conductive loops, such as illustrated in my prior patent U.S. Pat. No. 3,716,745 to which the reader may make reference, the microwave signal travels around one-half of a ring and then travels over a loop to the next ring, and so on to the end of the slow wave circuit. Thus given a helix with the same diameter and number of turns or loops as a given ring-loop type of circuit, the "pitch" of the two circuits is the same, but, as is apparent, since the microwave signal travels only over half of a ring and then passes over to the next ring the relative axial velocity of a microwave signal applied to the ring loop is twice as fast as the velocity of a signal applied to the helix. As is known to those skilled in the art, there are limitations on both the maximum and minimum number of rings per unit length, i.e. pitch, for a ring-loop slow wave circuit just as with the helix type.

The electrons attain a velocity by accelerating the electrons over a given distance under the influence of an accelerating electric field and the exact velocity depends on the level of the electric field as well as the distance traveled. The electric field is established by the high DC voltage applied by a power supply to anode of the traveling wave tube. In the traveling wave tube the accelerating voltage is applied between the cathode which emits electrons and the anode, which is spaced from the cathode. The electrons are accelerated to the desired velocity and pass through an opening in the anode to shoot out at the proper velocity into the interaction region containing the slow wave circuit. Given the foregoing, the designer may "match" the electron velocity and the propagation velocity.

In reviewing the foregoing, a traveling wave tube having a helix slow wave structure and another tube having a ring-loop slow wave structure of the same pitch as the helix, it is recalled that the microwave signal applied to the ring-loop propagates or travels at twice the axial velocity as that applied to the helix. To thus match the electron velocity to the propagation velocity in the ring-loop tube requires that the accelerating voltage for the electrons be four times as large in a ring-loop traveling wave tube as in a helix type, other factors held constant, or, in any case, requires that the electron velocity be twice as large. Clearly the kinetic energy possessed by the electrons in the ring-loop tube of the preceding example is four times as large as the energy of the moving electrons in the comparable helix type traveling wave tube.

In the operation of a traveling wave tube the kinetic energy of the moving electrons is dissipated in two ways: A portion of the energy is given up to the microwave signal during electronic interaction resulting in amplification of the microwave signal on the slow wave circuit, and the remaining portion is dissipated in the collector as the slowed electron passes out the end of the slow wave structure at reduced energy and collides with the collector. Thus it is apparent that the ring-loop type of traveling wave tube results in higher power microwaves signal outputs as well as higher power dissipation in the collector than the helix type.

The reader may consider next the slow wave circuit of the invention, which I refer to simply as a meandix circuit because of the partial physical similarity to both a meander line slow wave circuit, as illustrated in U.S. Pat. No. 3,736,534, and to a helix slow wave circuit. I have found that the meandix has narrow bandwidth, just like the ring-loop slow wave circuit and in contrast to the broad bandwidth of the helix type slow wave structure; has a high interaction impedance much like the ring-loop slow wave circuit and in contrast to the lower interaction impedence of the helix slow wave structure. The meandix I have found has high dispersiveness much like the ring-loop circuit and in contrast to the relatively low dispersiveness of the helix circuit. Thus the meandix slow wave circuit of the invention has many of the same advantageous characteristics for specific applications in which the ring-loop slow wave structure characteristics would be desirable in contrast to a helix slow wave structure. Next, inasmuch as the microwave signal applied to the meandix must travel over each loop, the axial velocity of the microwave signal is the same as that required for the helix. Thus for a specified axial velocity of microwave signal the "pitch" of the meandix circuit is the same pitch as a helix and, as compared to the ring-loop slow wave circuit of the same pitch, the velocity of the microwave signal on the meandix is one-half that of the velocity on the ring-loop circuit. Thus a lower electron velocity needs to be imparted to the electrons by an accelerating electric field. Just like the helix type slow wave circuit, the accelerating voltage required to accelerate the electrons to the proper velocity in a traveling wave tube containing the meandix slow wave circuit is one-fourth of that voltage required to accelerate electrons in a traveling wave tube using a ring-loop slow wave structure, other structure remaining the same. As a result, a traveling wave tube employing my meandix slow wave circuit uses electrons of lower velocity and hence lower kinetic energy than a traveling wave tube using a ring-loop of the same pitch. Thus lower power is required to be imparted to the microwave signal for amplification, and a lower power is dissipated in the collector. In the foregoing respect, the meandix slow wave circuit achieves lower power outputs and collector dissipation conveniently in instances where the ring-loop slow wave circuit cannot. Yet the meandix retains many of the desired electrical characteristics of a ring-loop type of structure. As compared to the ring-loop TWT, less heat is generated in the collector through dissipation of the electron's kinetic energy, resulting in a better, more reliable traveling wave tube possessing otherwise most of the electrical characteristics of the ring-loop traveling wave tube.

It is recognized that the pitch of a ring-loop structure may be increased by increasing the number of rings and reducing the ring-to-ring spacing and as a consequence the axial propagation velocity of the microwave signal is reduced as is the velocity of the electrons needed for interaction and the electron's kinetic energy is reduced. The comparison remains valid however, if one considers the structure in which minimum ring-to-ring spacing, i.e. maximum pitch, available with the ring-loop circuit at a given frequency is achieved, where any further increase in pitch does not result in a lower propagation velocity or electron velocity. In that event the benefits of a meandix circuit of the invention having the same pitch as the ring-loop circuit is even more pronounced.

What I have found is that the aforedescribed slow wave circuit, which I may refer to simply as a "meandix" circuit, is slightly more dispersive than the ring-loop circuit of the prior art. And for a given turn-to-turn spacing the synchronous interaction velocity of the meandix circuit is one-half or 50 percent less than the corresponding velocity of the prior art ring-loop circuit. I have also found that for a given turn-to-turn spacing the interaction impedance of the meandix circuit is twice that or 200 percent greater than that of the ring-loop circuit. The circuit operates at a bandwidth and efficiency of a ring-loop circuit but at 1/32nd of the peak power level to thus perform the same function performed by a ring-loop circuit in traveling wave tubes of the 250 watt to 25 kilowatt range in the 5 watt or 1 kilowatt region. Additionally, the meandix circuit provides higher gain per wavelength, greater efficiency and much lower harmonic power generation than the conventional helix slow wave circuit, and thus is superior to the helix and more like the ring-loop circuit in communication and radar application where small size, light weight, high efficiency and low harmonic generation are important. The higher dispersion and much higher interaction impedance function to provide a calculated bandwidth for the meandix circuit approximately equal to that of the ring-loop circuit. The dispersion has the added advantage that second harmonic power is negligible, in the range of 30 to 35 db down from the fundamental. This results in low $\gamma A$ operation where the on axis impedance is highest without suffering power losses due to second harmonic generation that occurs in tubes using the helix slow wave structure a relative broadband structure. And as previously discussed at some length, for a given turn-to-turn spacing both the helix and meandix circuits have about one-half the velocity of the ring-loop circuit. This 2 to 1 difference in velocity produces a 32 to 1 difference in peak power for a given value of $\gamma A$ and beam perveance. The net result of the 2 to 1 advantage of interaction impedance of the meandix over the ring-loop circuits is that the two circuits have the same gain parameter for equal circuit pitch, beam perveance and $\gamma A$. Hence they will operate at the same electrical efficiency.

Figure 7:
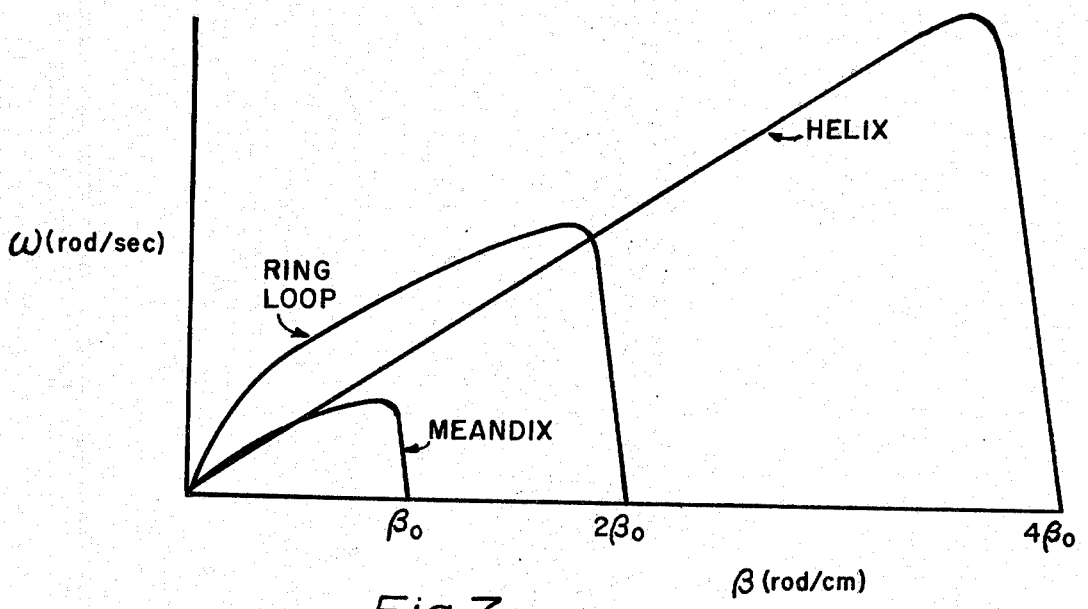
FIG. 7 is a graphic comparison of the $\omega$-$\beta$ characteristics of the invention with certain prior art slow wave structures.

Reference is made to the $\omega$-$\beta$ diagram of FIG. 7 which compares the $\omega$-$\beta$ characteristics of the meandix, the ring-loop circuit and the helix circuit. For a given ring-to-ring spacing the fundamental period of the meandix circuit is twice that of the ring-loop circuit and four times that of the helix circuit. For a given ring-to-ring or turn-to-turn spacing the phase velocity, $\omega/\beta$, is about equal for the meandix and the helix and is half as great in the meandix circuit as in the ring-loop circuit at any given frequency, $f$. The increased cut-off wavelength, $\beta o$, for the meandix circuit, results in a relatively low upper cut-off frequency.

I have illustrated the slow wave circuit separately. However those skilled in the art recognize that this slow wave circuit may be combined with other slow wave circuits of different structure in order to obtain desired results where one slow wave structure is used in a traveling wave tube as part of the input or output coupling circuit and the other slow wave circuit is used for interaction (see U.S. Pat. No. 3,735,188) or where two slow wave circuits are both used for interaction spaced in the tube with attenuative material and beam coupled as is known to those skilled in the art and described in my patent U.S. Pat. No. 3,716,745.

Although I believe the configuration of an electrically conductive element as described is in itself novel and possesses utility as herein disclosed, it is conceivable that a conductive element may exist heretofore in unrelated prior art where someone has for ornamental purposes or otherwise bent a wire into the shape I have disclosed but with no realization or teaching to those in the microwave apparatus art that such a configuration is particularly useful as an element of a microwave frequency apparatus functioning as a slow wave structure to propagate microwave frequency energy with the aforedescribed electrical charcteristics. In characterizing the conductor configuration as a slow wave structure and in a microwave frequency apparatus, it is intended that my invention be considered patentably novel as an improved combination or as a new use apart from the simple bent wire per se. Thus even if in the thousands of physical structures as may exist in unrelated prior art or imagined, one is uncovered of a geometry similar or identical to that which I have disclosed as a slow wave structure, it is believed that such is not anticipatory of the slow wave circuit of my invention inasmuch as the structure by itself without the additional discovery of, teaching of, or suggestion of its characteristics in a microwave energy circuit, would appear to me to be purely speculative to those skilled in the microwave apparatus field.

I believe the foregoing detailed description of a preferred embodiment of my invention presents the invention in detail sufficient to enable one skilled in the art to make and use same. In so doing it is understood that my invention is not to be limited to those details inasmuch as many variations and equivalents, all of which embody my invention, become apparent to those skilled in the art upon reading this specification. It is thus expressly requested that my invention be broadly construed within the full spirit and scope of the appended claims.

What I claim is:

1. In combination with a microwave frequency apparatus, the slow wave structure comprising: an electrically conductive wire formed into a plurality of serially connected helices of two turns each, said helices located along a common axis;

and wherein intermediate ones of said helices extend around about said common axis in a clockwise direction and alternate ones of said helices extend around about said common axis in a counterclockwise direction to provide a series electrically conductive microwave energy propagating path that progresses serially through said helices.

2. The combination as defined in claim 1 further comprising: first microwave energy coupling means for coupling microwave energy to one end of said slow wave structure and second microwave energy coupling means for coupling microwave energy from the other end of said structure.

3. The combination as defined in claim 2 further comprising: a plurality of dielectric rods for supporting said slow wave structure.

4. The combination as defined in claim 3 further comprising: microwave dissipative material for presenting an electrical impedance to certain microwave energy on said slow wave structure.

5. The combination as defined in claim 1 wherein said microwave frequency apparatus comprises a traveling wave tube.

6. The invention as defined in claim 1 wherein the ratio of the loop-to-loop axial spacing measured from the center of the wire comprising the loop, $g$, to the inner diameter of the loop, $d$, namely $g/d$, falls in the range: $0.1<g/d<0.5$.

7. In combination with a microwave frequency apparatus the slow wave structure comprising:

an electrically conductive wire formed into a series of substantially identical loops spaced apart and parallel along a common axis, said loops being arranged in alternate and intermediate pairs with intermediate pairs of loops located in between alternate pairs of loops, said loops in said alternate pairs extending counterclockwise about said common axis and said loops of said intermediate pairs extending clockwise about said common axis and with said loops interconnected with one another to provide a series electrically conductive microwave energy propagating path that progresses from one end of said wire to the other seriatim through all said loops without retracing axially.

8. The invention as defined in claim 7 wherein said microwave frequency device comprises a traveling wave tube.

9. The invention as defined in claim 7 wherein said microwave frequency device comprises a phase shifter.

10. The combination as defined in claim 7 further comprising: first microwave energy coupling means for coupling microwave energy to one end of said slow wave structure and second microwave energy coupling means for coupling microwave energy from the other end of said structure.

11. The combination as defined in claim 7 further comprising: a plurality of dielectric rods for supporting said slow wave structure.

12. The combination as defined in claim 7 further comprising: microwave dissipative material for presenting an electrical impedance to certain microwave energy on said slow wave structure.

13. The invention as defined in claim 7 wherein the ratio of the loop-to-loop axial spacing measured from the center of the wire comprising the loop, $g$, to the inner diameter of the loop, $d$, namely $g/d$, falls in the range: $0.1<g/d<0.5$.

14. In combination with a microwave frequency apparatus of the type having a slow wave structure, the improvement wherein said slow wave circuit comprises:

a plurality of substantially identical circular loops of electrically conductive wire spaced parallel along a common axis, each of said loops extending about said axis by more than 270° and less than 360° so as to form an incomplete circle and with said loops being arranged substantially in alignment;

a plurality of connecting conductor portions for electrically connecting together each loop end with a loop end of an adjacent loop, the one of said connecting portions connecting any given loop to an adjacent loop axially located to one side thereof oriented skew to said common axis and another one of said connecting portions connecting the remaining loop end of said given loop to an adjacent loop axially located to the other side of said given loop being substantially parallel to said common axis;

said loops and connecting portions being integrally formed from a single electrically conductive wire to provide a continuous electrically conductive path that extends through and places in electrical series circuit all portions of said loops and said connecting portions.

15. The invention as defined in claim 14 wherein said loops are evenly spaced from one another along said common axis.

16. The combination as defined in claim 14 further comprising: first microwave energy coupling means for coupling microwave energy to one end of said slow wave structure and second microwave energy coupling means for coupling microwave energy from the other end of said structure.

17. The combination as defined in claim 14 further comprising: a plurality of dielectric rods for supporting said slow wave structure.

18. In combination with a microwave frequency apparatus, a slow wave circuit comprising:

a single strand of electrically conductive wire formed into a series of substantially identical loops and a series of loop connecting portions joining ends of adjacent loops, said loops forming incomplete circles and being arranged along a common axis in a plurality of spaced parallel planes and aligned with said loop portions overlying one another;

each of said loops being capable of being divided into two symmetrical portions by a plane of symmetry through said axis;

and connecting portions joining ends of adjacent loops together above said plane, including a first connecting portion joining an end of a first loop to an end of a second loop extending substantially parallel to said common axis;

a second connecting portion joining the remaining end of said second loop to one end of said third loop extending skew to said common axis from below said plane to above said plane and intersecting said plane;

a third connecting portion joining the remaining end of said third loop and an end of a fourth loop extending substantially parallel to said axis and located below said plane; and a fourth connecting portion joining the remaining end of said fourth loop with an end of a fifth loop, extending skew to said common axis from above said plane to below said plane intersecting said plane; whereby an electrically conductive path is formed which extends counterclockwise about said axis for two of said adjacent loops and thereupon extends clockwise about said axis for the next two loops to thereby place each portion of each loop and each connecting portion in an electrical series circuit.

19. The combination as defined in claim 18 further comprising: first microwave energy coupling means for coupling microwave energy to one end of said slow wave structure and second microwave energy coupling means for coupling microwave energy from the other end of said structure.

20. The combination as defined in claim 18 further comprising: a plurality of dielectric rods for supporting said slow wave structure.

* * * * *

UNITED STATES PATENT AND TRADEMARK OFFICE

CERTIFICATE OF CORRECTION

PATENT NO. : 4,004,179

DATED : January 18, 1977

INVENTOR(S) : Robert Matthews Phillips

It is certified that error appears in the above-identified patent and that said Letters Patent are hereby corrected as shown below:

In Column 1, line 18, the word "or" (second occurrence) should read -- of --. In Column 4, line 5, "be" should be omitted. In Column 5, line 42, "B" should be -- $\overline{B}$ --. In Column 6, line 44, "g/a" should read -- g/d --.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*